US007455568B2

(12) United States Patent
Sekiya

(10) Patent No.: US 7,455,568 B2
(45) Date of Patent: Nov. 25, 2008

(54) WATER JET-PROCESSING MACHINE

(75) Inventor: Kazuma Sekiya, Tokyo (JP)

(73) Assignee: Disco Corporation, Tokyo (JP)

( * ) Notice: Subject to any disclaimer, the term of this patent is extended or adjusted under 35 U.S.C. 154(b) by 473 days.

(21) Appl. No.: 11/061,569

(22) Filed: Feb. 22, 2005

(65) Prior Publication Data

US 2005/0191951 A1 Sep. 1, 2005

(30) Foreign Application Priority Data

Feb. 23, 2004 (JP) ..... 2004-045600

(51) Int. Cl.
*B24B 49/00* (2006.01)
*B24B 51/00* (2006.01)

(52) U.S. Cl. ..... 451/2; 451/8; 451/11; 451/75

(58) Field of Classification Search ..... 134/56 R, 134/113; 451/2, 5, 8, 9, 10, 11, 14, 75, 99
See application file for complete search history.

(56) References Cited

U.S. PATENT DOCUMENTS 3,880,028 A * 4/1975 Frederick, Jr. ..... 83/880
4,905,897 A * 3/1990 Rogers et al. ..... 239/1
5,222,329 A * 6/1993 Yu ..... 451/11
5,240,552 A * 8/1993 Yu et al. ..... 438/5
5,439,551 A * 8/1995 Meikle et al. ..... 438/5
6,155,245 A * 12/2000 Zanzuri ..... 125/12
6,230,660 B1 * 5/2001 Greeson ..... 119/665
6,769,956 B1 * 8/2004 Konieczny ..... 451/2
6,814,649 B2 * 11/2004 Schmall ..... 451/2
6,852,002 B2 * 2/2005 Stewart et al. ..... 451/2
7,100,621 B2 * 9/2006 Johnson ..... 134/123

FOREIGN PATENT DOCUMENTS

JP 2002-205298 7/2002

* cited by examiner

*Primary Examiner*—Timothy V Eley
(74) *Attorney, Agent, or Firm*—Smith, Gambrell & Russell, LLP

(57) ABSTRACT

A water jet-processing machine comprising a workpiece holding table having a holding surface for holding a workpiece, a nozzle for emitting a jet of processing water to the workpiece held on the holding surface of the workpiece holding table, a processing water supply means for supplying processing water containing abrasive grains to the nozzle and a moving means for moving the nozzle in a direction perpendicular to the holding surface of the workpiece holding table, wherein the machine further comprises processing sound wave detection means for detecting a processing sound wave generated by processing water ejected from the nozzle to the workpiece and a control means for controlling the moving means based on a detection signal detected by the processing sound wave detection means.

6 Claims, 8 Drawing Sheets

WATER JET-PROCESSING MACHINE

FIELD OF THE INVENTION

The present invention relates to a water jet-processing machine for cutting a plate-like workpiece such as a semiconductor wafer by emitting a jet of high-pressure water to the workpiece.

DESCRIPTION OF THE PRIOR ART

In the production process of a semiconductor device, individual semiconductor chips are manufactured by forming a circuit such as IC, LSI or the like in a large number of areas arranged in a lattice pattern on the front surface of a substantially disk-like semiconductor wafer, and dicing the semiconductor wafer into the areas having each a circuit formed thereon along predetermined cutting lines called "streets". The thus divided semiconductor chips are packaged, and widely used in electric appliances such as cellular phones, personal computers or the like.

Lighter and smaller electric appliances such as cellular phones, personal computers or the like are now in demand, and packaging technologies called "Chip Size Package (CSP)" that can reduce the size of a semiconductor chip package have already been developed. As one of the CSP technologies, a packaging technology called a "Quad Flat Non-lead Package (QFN)" has been implemented. In this QFN packaging technology, a CSP substrate is formed by arranging a plurality of semiconductor chips in a matrix form on a metal plate such as a copper plate, on which a plurality of connection terminals corresponding to the connection terminals of the semiconductor chips are formed and streets arranged in a lattice pattern for sectioning the semiconductor chips are formed, and by integrating the metal plate with the semiconductor chips by means of a resin portion formed by molding a resin from the reverse surface side of the semiconductor chips. This CSP substrate is cut along the streets to be divided into individual chip size packages (CSP).

The above CSP substrate is generally cut with a precision cutting machine called "dicing machine". This dicing machine comprises a cutting blade having an annular abrasive grain layer and cuts the CSP substrate along the streets by moving this cutting blade relative to the CSP substrate along the streets of the CSP substrate while rotating the cutting blade so as to divide it into individual chip size packages (CSP) When the CSP substrate is cut with the cutting blade, however, a problem arises in that burrs are formed on the connection terminals to cause a short circuit between adjacent connection terminals, thereby reducing the quality and reliability of a chip size package (CSP).

Further, when not only the CSP substrate but a workpiece such as a semiconductor wafer is cut with the cutting blade, another problem occurs that fine chips are adhered onto the front surface of the workpiece, thereby contaminating the workpiece.

As a cutting technology for solving the above problems caused by cutting with the cutting blade, for example, JP-A 2002-205298 proposes a water jet cutting processing method for cutting a workpiece by emitting a jet of high-pressure water containing abrasive grains such as silica, garnet or diamond abrasive grains from a nozzle to the workpiece held by a workpiece holding means.

To cut the workpiece precisely in the above-described water jet cutting processing method, an interval between the squirt hole of the nozzle for ejecting processing water and the front surface of the workpiece must be maintained accurately.

That is, when processing is carried out by setting the interval between the squirt hole of the nozzle and the front surface of the workpiece to, for example, 50 μm, if the interval becomes larger than 100 μm, a problem arises that the processing accuracy will become unstable, whereby the cut grooves will become nonuniform in width, or an uncut area will be produced, or abrasive grains will be scattered to damage the surface of the workpiece, while if the interval between the squirt hole of the nozzle and the surface of the workpiece is smaller than the above set value, a problem occurs that the nozzle may contact with the workpiece to damage its surface. Meanwhile, the plate-like workpiece such as a CSP substrate is easily curved and hence, it is inevitable that the interval between the squirt hole of the nozzle and the surface of the workpiece held by the workpiece holding means becomes larger or smaller than the set value.

SUMMARY OF THE INVENTION

It is an object of the present invention to provide a water jet-processing machine capable of cutting a workpiece while always maintaining the interval between the squirt hole of a nozzle for emitting a jet of processing water and the surface of the workpiece at a predetermined range.

According to the present invention, the above object can be attained by a water jet-processing machine comprising a workpiece holding table having a holding surface for holding a workpiece, a nozzle for emitting a jet of processing water to the workpiece held on the holding surface of the workpiece holding table, a processing water supply means for supplying processing water containing abrasive grains to the nozzle and a moving means for moving the nozzle in a direction perpendicular to the holding surface of the workpiece holding table, wherein the machine further comprises a processing sound wave detection means for detecting a processing sound wave generated by processing water ejected from the nozzle to the workpiece and a control means for controlling the moving means based on a detection signal detected by the processing sound wave detection means.

The control means comprises a storage means for beforehand storing data on a frequency of a processing sound wave corresponding to the interval between the nozzle and the surface of the workpiece, and obtains the interval between the nozzle and the surface of the workpiece based on the frequency data stored in the storage means and a detection signal detected by the processing sound wave detection means to control the moving means so that the interval becomes a predetermined value.

The water jet-processing machine of the present invention detects a processing sound wave generated by processing water ejected from the nozzle to the workpiece and controls the moving means for moving the nozzle in a direction perpendicular to the holding surface of the workpiece holding table based on the detection signal. Therefore, even when the workpiece curves, the interval between the squirt hole of the nozzle and the surface of the workpiece can be always maintained at a predetermined range. Consequently, even when the workpiece curves, it can be cut highly accurately without fail and also, a problem that the nozzle contacts the workpiece to damage its surface can be eliminated.

DETAILED DESCRIPTION OF THE PREFERRED EMBODIMENTS

Preferred embodiments of a water jet-processing machine constituted according to the present invention will be described in detail herein under with reference to the accompanying drawings.

Figure 1:
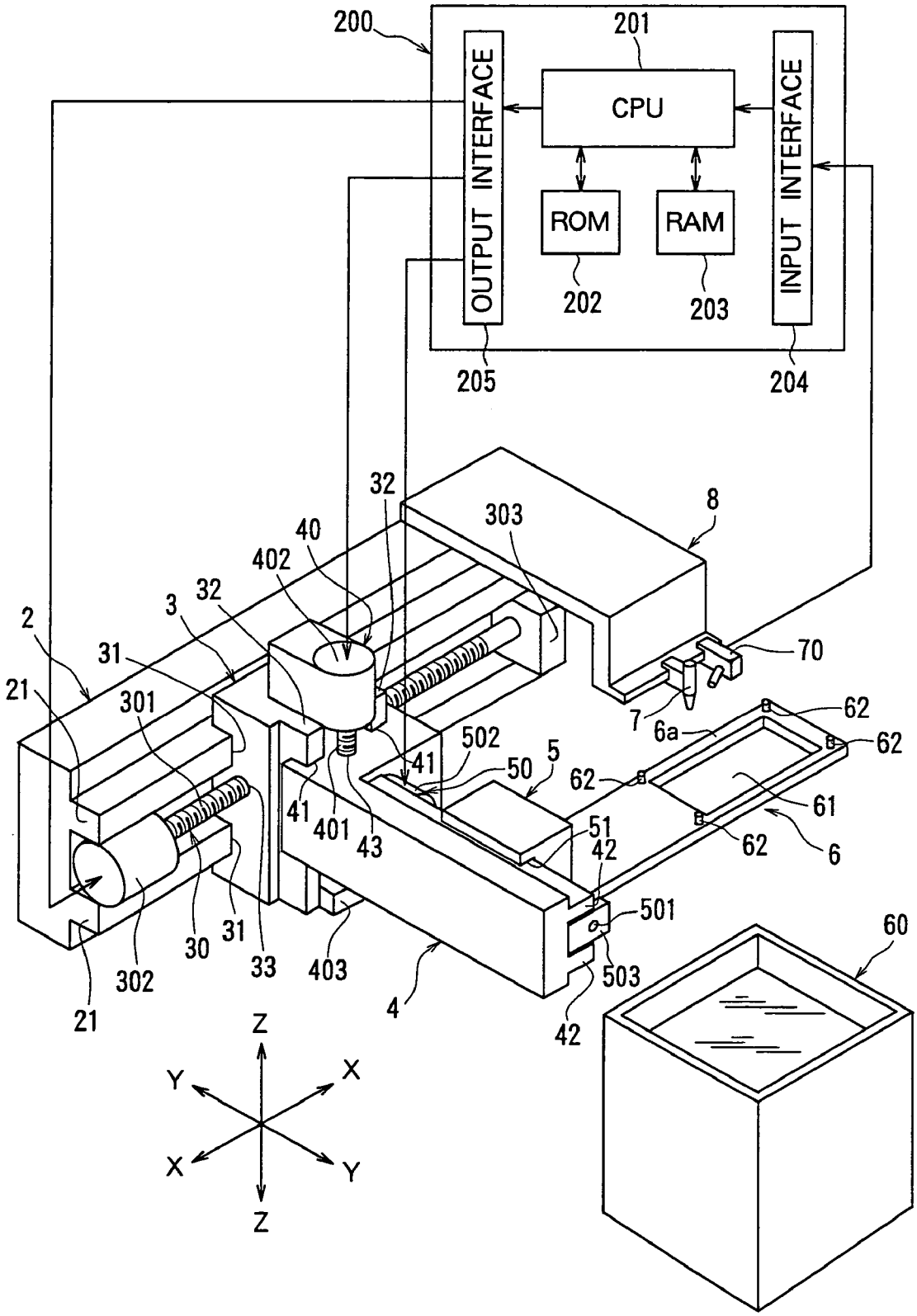
FIG. 1 is a perspective view of the principal section of a water jet-processing machine constituted according to the present invention.

FIG. 1 is a perspective view of the principal section of a water jet-processing machine constituted according to the present invention. The water jet-processing machine shown in FIG. 1 comprises a stationary base 2, a first movable base 3, a second movable base 4 and a third movable base 5. A pair of guide rails 21 and 21 extending parallel to each other in the direction indicated by an arrow X are formed on the flank side of the stationary base 2.

The first movable base 3 has a pair of to-be-guided grooves 31 and 31 that are formed on one flank opposed to the above stationary base 2 in the direction indicated by the arrow X and are slidably fitted to the pair of guide rails 21 and 21 formed on the stationary base 2, and a pair of guide rails 32 and 32 that formed on the other flank and extend parallel to each other in the direction indicated by the arrow Z. By fitting the pair of to-be-guided grooves 31 and 31 to the pair of guide rails 21 and 21, the thus constituted first movable base 3 is supported to the stationary base 2 in such a manner that it can move in the direction indicated by the arrow x. The water jet-processing machine in the illustrated embodiment comprises a first moving means 30 for moving the first movable base 3 along the pair of guide rails 21 and 21 provided on the above stationary base 2 in the direction indicated by the arrow X. The first moving means 30 has a male screw rod 301 arranged between the pair of guide rails 21 and 21 and parallel thereto, and a pulse motor 302 for rotationally driving the male screw rod 301. The male screw rod 301 is screwed into a female screw 33 formed in the above first movable base 3, and one end thereof is rotatably supported to a bearing member 303 fixed to the stationary base 2. The drive shaft of the pulse motor 302 is connected to the other end of the male screw rod 301 so that the first movable base 3 is moved along the pair of guide rails 21 and 21 formed on the stationary base 2 in the direction indicated by the arrow X by rotating the male screw rod 301 in a normal direction or reverse direction.

The above second movable base 4 has a pair of to-be-guided grooves 41 and 41 that formed on one flank opposed to the first movable base 3 in the direction indicated by the arrow Z and are slidably fitted to the pair of guide rails 32 and 32 formed on the first movable base 3, and a pair of guide rails 42 and 42 that are formed on a flank perpendicular to the above one flank and extend in the direction indicated by the arrow Y. By fitting the pair of to-be-guided grooves 41 and 41 to the pair of guide rails 32 and 32, the thus constituted second movable base 4 is supported to the first movable base 3 in such a manner that it can move in the direction indicated by the arrow Z. The water jet-processing machine in the illustrated embodiment comprises a second moving means 40 for moving the second movable base 4 along the pair of guide rails 32 and 32 provided on the first movable base 3 in the direction indicated by the arrow Z. The second moving means 40 has a male screw rod 401 arranged between the pair of guide rails 32 and 32 and parallel thereto, and a pulse motor 402 for rotationally driving the male screw rod 401. The male screw rod 401 is screwed into a female screw 43 formed in the second movable base 4, and one end thereof is rotatably supported to a bearing member 403 fixed to the first movable base 3. The drive shaft of the pulse motor 402 is connected to the other end of the male screw rod 401 so that the second movable base 4 is moved along the pair of guide rails 32 and 32 provided on the first movable base 3 in the direction indicated by the arrow Z by rotating the male screw rod 401 in a normal direction or reverse direction. The direction indicated by the arrow Z is defined as a direction perpendicular to the holding surface of a workpiece holding table for holding a workpiece which will be described later.

The above third movable base 5 has a pair of to-be-guided grooves 51 and 51 (only an upper groove is shown in FIG. 1) that are formed on one flank opposed to the above second movable base 4 in the direction indicated by the arrow Y and are slidably fitted to the pair of guide rails 42 and 42 provided on the above second movable base 4, and is supported to the second movable base 4 in such a manner that it can move in the direction indicated by the arrow Y by fitting the pair of guide grooves 51 and 51 to the pair of guide rails 42 and 42. The water jet-processing machine in the illustrated embodiment comprises a third moving means 50 for moving the third movable base S along the pair of guide rails 42 and 42 provided on the above second movable base 4 in the direction indicated by the arrow Y. The third moving means 50 has a male screw rod 501 arranged between the pair of guide rails 42 and 42 and parallel thereto, and a pulse motor 502 for rotationally driving the male screw rod 501. The male screw rod 501 is screwed into a female screw (not shown) formed in the above third movable base 5, and one end thereof is rotatably supported to a bearing member 503 fixed to the second movable base 4. The drive shaft of the pulse motor 502 is connected to the other end of the male screw rod 501 so that the third movable base 5 is moved along the pair of guide rails 42 and 42 formed on the second movable base 4 in the direction indicated by the arrow Y by rotating the male screw rod 501 in a normal direction or reverse direction.

A workpiece holding table 6 extending in the direction indicated by the arrow X is mounted to the other flank of the above third movable base 5. The workpiece holding table 6 has a holding surface 6*a* for holding a workpiece on its upper surface. A rectangular opening 61 is formed in the workpiece holding table 6 having the above holding surface 6*a*, and four positioning pins 62 project from the upper surface around the opening 61. The water jet-processing machine in the illustrated embodiment comprises a water tank 60 that is installed below the workpiece holding table 6 and stores water for buffering a jet of water which will be described later.

A nozzle 7 that has a squirt hole with a diameter of about 200 μm and emits a jet of water to the workpiece held on the workpiece holding table 6 is arranged above the workpiece holding table 6. This nozzle 7 is attached to a nozzle support member 8 fixed on the above stationary base 2, and processing water containing abrasive grains is supplied to the nozzle 7 by a processing water supply means which will be described later. The water jet-processing machine in the illustrated embodiment comprises a processing sound wave detection means 70 for detecting a processing sound wave generated by processing water ejected from the above nozzle 7 to the workpiece held on the above workpiece holding table 6. This processing sound wave detection means 70 is composed of an ultrasonic detector in the illustrated embodiment, and is attached to the above nozzle support member 8. The processing sound wave detection means 70 composed of an ultrasonic detector converts a frequency of a processing sound wave which is a detection signal into a voltage signal, and sends it to a control means 200.

The control means 200 is composed of a computer comprising a central processing unit (CPU) 201 for carrying out arithmetic processing based on a control program, a read-only memory (ROM) 202 for storing the control program and data on the respective frequencies of processing sound waves corresponding to the intervals between the nozzle 7 and the surface of the workpiece, a readable and writable random access memory (RAM) 203 for storing the results of arithmetic processings, an input interface 204 and an output interface 205. Detection signals from the above processing sound wave detection means 70 and the other is input to the input interface 204 of the thus constituted control means 200. A control signal is output to the pulse motor 302 of the above first moving means, the pulse motor 402 of the above second moving means 2, the pulse motor 502 of the above third moving means 50 and the other from the output interface 205.

Figure 3:
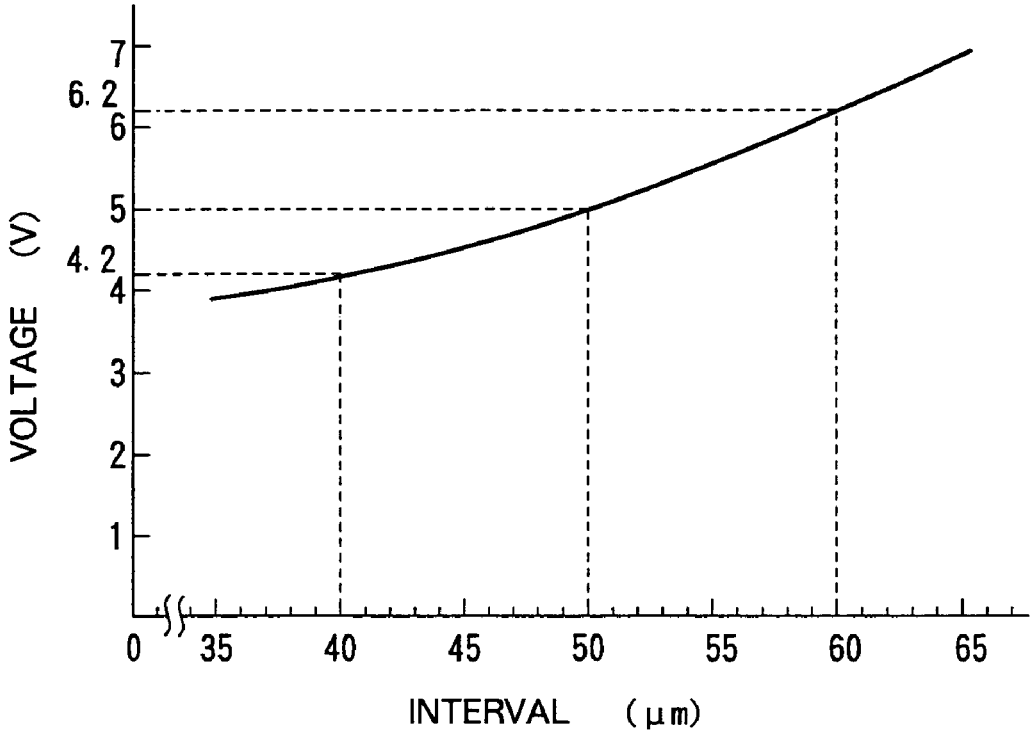
FIG. 3 shows a frequency data map stored in the memory of a control means provided in the water jet-processing machine shown in FIG. 1.

Data on the frequencies of processing sound waves corresponding to the intervals between the nozzle and the surface of the workpiece, which are stored in the read-only memory (ROM) 202, will be described with reference to FIG. 3. In FIG. 3, an axis of abscissas shows the interval (μm) between the nozzle 7 and the surface of the workpiece, and an axis of ordinates shows a voltage value (V) output from the processing sound wave detection means 70. As understood from FIG. 3, the processing sound wave detection means 70 is so designated as to make the output voltage value (V) increase as the interval (μm) between the nozzle 7 and the surface of the workpiece becomes larger. Data shown in FIG. 3 are obtained from a voltage value (V) output from the processing sound wave detection means 70 in experiments conducted by changing the interval between the nozzle 7 and the surface of the workpiece in a range of from 35 μm to 65 μm in increments of 1 μm, and beforehand stored in the read-only memory (ROM) 202 as a frequency data map.

A description is subsequently given of a processing water supply means 9 for supplying processing water containing abrasive grains to the above nozzle 7 with reference to FIG. 2.

Figure 2:
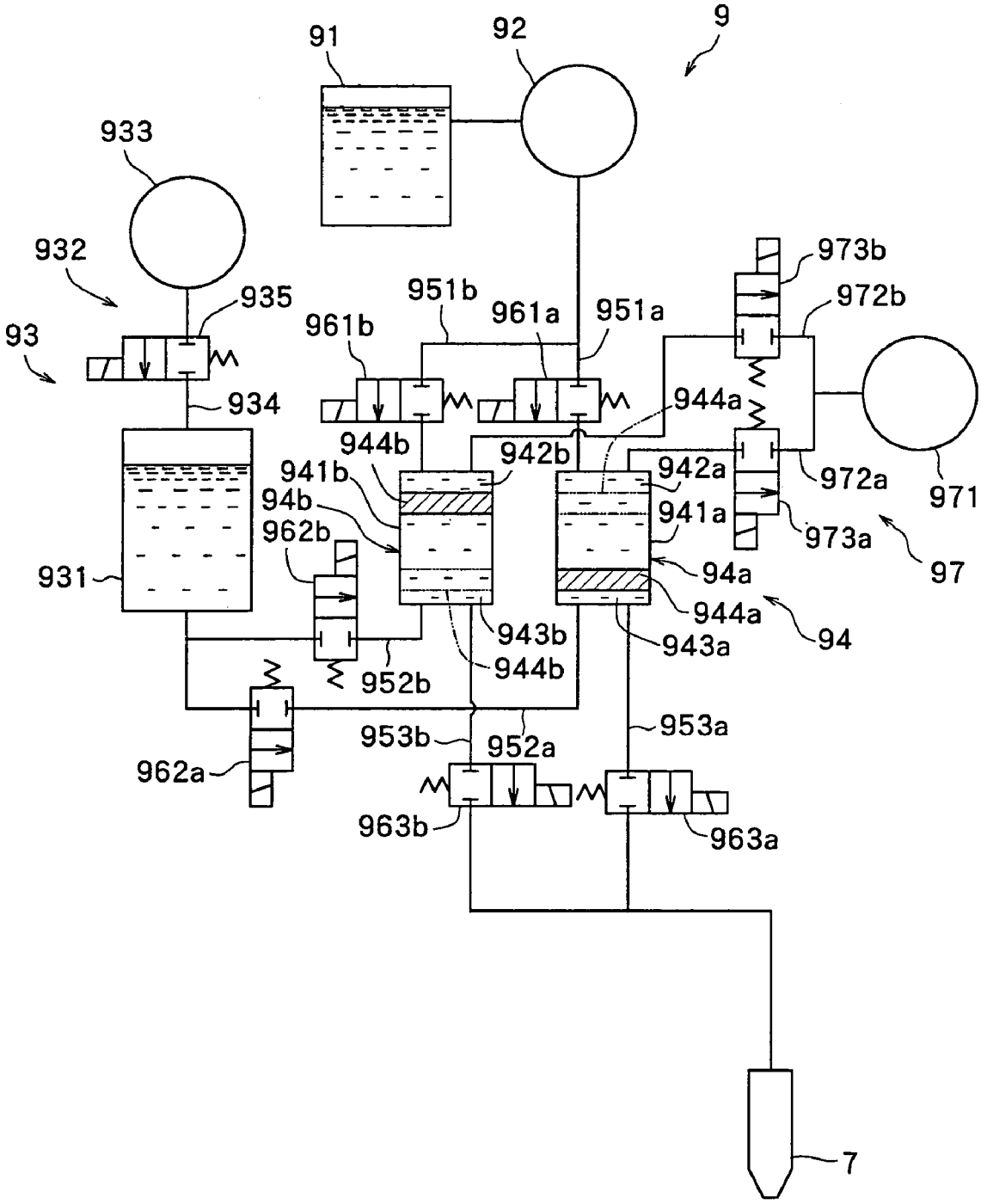
FIG. 2 is a fluid circuit diagram of a processing water supply means provided in the water jet-processing machine shown in FIG. 1.

The processing water supply means 9 shown in FIG. 2 comprises a water tank 91, a high-pressure water generating means 92, a processing water storage means 93 and a processing water delivery means 94. The water tank 91 stores a fresh water such as tap water or pure water. The high-pressure water generating means 92 increases the pressure of water supplied from the water tank 91 to 50 to 100 MPa to supply it to the processing water delivery means 94.

The above processing water storage means 93 comprises a processing water storage tank 931 and a pressure means 932 for pressurizing processing water stored in the processing water storage tank 931. The processing water storage tank 931 stores processing water that is a mixture of water and fine abrasive grains such as silica, garnet, diamond grains or the like. The pressure means 932 comprises an air pump 933, a pressure pipe 934 for communicating the air pump 933 with an air introduction port formed in the upper wall of the above processing water storage tank 931, and an electromagnetic changeover valve 935 installed in the processing pipe 934.

The above processing water delivery means 94 comprises a first processing water delivery means 94*a* and a second processing water delivery means 94*b* in the illustrated embodiment. The first processing water delivery means 94*a* comprises a first cylinder 941*a* and a first piston 944*a* that is slidably installed in the first cylinder 941*a* and partitions the inside space of the first cylinder 941*a* into a first chamber 942*a* and a second chamber 943*a*. Also, the second processing water delivery means 94*b* comprises a second cylinder 941*b* and a second piston 944*b* that is slidably installed in the second cylinder 941*b* and partitions the inside space of the second cylinder 941*b* into a first chamber 942*b* and a second chamber 943*b*. A diaphragm may be used to partition the inside space of the cylinder into a first chamber and a second chamber, in place of the first piston 944*a* and the second piston 944*b*. That is, the piston or diaphragm for partitioning the inside space of the cylinder into the first chamber and the second chamber functions as a partition member, which partitions the inside space of the cylinder into the first chamber and the second chamber and can be displaced by the pressures of the both chambers.

The first chambers 942*a* and 942*b* of the first cylinder 941*a* and the second cylinder 941*b* constituting the first processing water delivery means 94*a* and the second processing water deliver means 94*b* are communicated with the above high-pressure generating means 92 via high-pressure pipes 951*a* and 951*b*, respectively. The high-pressure pipes 951*a* and 951*b* are provided with electromagnetic changeover valves 961*a* and 961*b*, respectively. The first chambers 942*a* and 942*b* of the first cylinder 941*a* and the second cylinder 941*b* are respectively communicated with a drainage means 97. This drainage means 97 comprises a vacuum pump 971 as a suction means, drainage pipes 972*a* and 972*b* for communicating the vacuum pump 971 with the above first chambers 942*a* and 942*b*, and electromagnetic changeover valves 973*a* and 973*b* installed in the drainage pipes 972*a* and 972*b*, respectively.

The second chambers 943*a* and 943*b* of the first cylinder 941*a* and the second cylinder 941*b* constituting the first processing water delivery means 94*a* and the second processing water delivery means 94*b* are communicated with the above processing water storage tank 931 via introduction pipes 952*a* and 952*b*, respectively. The introduction pipes 952*a* and 952*b* are provided with electromagnetic changeover valves 962*a* and 962*b*, respectively. The second chambers 943*a* and 943*b* of the first cylinder 941*a* and the second cylinder 941*b* are communicated with the above nozzle 7 via delivery pipes 953*a* and 953*b*, respectively. The delivery pipes 953*a* and 953*b* are provided with electromagnetic changeover valves 963*a* and 963*b*, respectively.

The above high-pressure water generating means 92, the air pump 933, the electromagnetic changeover valves 935, 961*a* and 961*b*, the electromagnetic changeover valves 962*a* and 962*b*, 963*a*, 963*b*, the electromagnetic changeover valves 973*a* and 973*b*, the vacuum pump 971, etc. are controlled by the above control means 200.

The processing water supply means 9 shown in FIG. 2 is constituted as described above, and its function will be described hereinbelow.

At the start of the operation of the processing water supply means 9, the high-pressure water generating means 92, the vacuum pump 971 and the air pump 933 are activated, and all the electromagnetic changeover valves are in a state of turn-off, as shown in FIG. 2. To activate the first processing water delivery means 94*a* from the state shown in FIG. 2, the electromagnetic changeover valve 973*a* of the drainage means 97 is turned on and the electromagnetic changeover valve 962*a* is also turned on. As a result, high-pressure water in the first chamber 942*a* of the first cylinder 941*a* is sucked into the vacuum pump 971 through the drainage pipe 972*a* and the electromagnetic changeover valve 973*a* and simultaneously, processing water in the processing water storage tank 931 is introduced into the second chamber 943*a* of the first cylinder 941*a* through the introduction pipe 952*a* and the electromagnetic changeover valve 962*a*, thereby moving upward the first piston 944*a* in FIG. 2. When the first piston 944*a* is moved to an upper position shown by the two-dot chain line in FIG. 2, the above electromagnetic changeover valve 973*a* and the electromagnetic changeover valve 962*a* are turned off. Then, the electromagnetic changeover valve 963*a* is turned on and the electromagnetic changeover valve 961*a* is also turned on. Therefore, high-pressure water generated by the high-pressure water generating means 92 is introduced into the first chamber 942*a* of the first cylinder 941*a* through the high-pressure pipe 951*a* and the electromagnetic changeover valve 961*a* to press down the first piston 944*a* in FIG. 2. As a result, processing water in the second chamber 943*a* of the first cylinder 941*a* is introduced into the nozzle 7 through the deliver pipe 953*a* and the electromagnetic changeover valve 963*a*, and is ejected as a jet of water. When the first piston 944*a* of the first cylinder 941*a* reaches a lower position shown by the solid line in FIG. 2, the electromagnetic changeover valve 961*a* is turned off and further, the electromagnetic changeover valve 963*a* is turned off to return to the state shown in FIG. 2.

A description is subsequently given of the operation of the second processing water delivery means 94*b*.

The state shown in FIG. 2 is a state where the second piston 944*b* constituting the second processing water delivery means 94*b* is moved to an upper position shown by a solid line to introduce processing water into the second chamber 943*b* of the second cylinder 941*b*. When the electromagnetic changeover valve 963*b* is turned on and the electromagnetic changeover valve 961*b* is also turned on from this state, high-pressure water generated by the high-pressure water generating means 92 is introduced into the first chamber 942*b* of the second cylinder 941*b* through the high-pressure pipe 951*b* and the electromagnetic changeover valve 961*b* to press down the piston 944*b* in FIG. 2. As a result, processing water in the second chamber 943*b* of the second cylinder 941*b* is introduced into the nozzle 7 through the delivery pipe 953*b* and the electromagnetic changeover valve 963*b*, and is ejected as a jet of water. When the piston 944*b* of the second cylinder 941*b* reaches a lower position shown by the two-dot chain line in FIG. 2, the electromagnetic changeover valve 961*b* is turned off and the electromagnetic changeover valve 963*b* is also turned off. When the electromagnetic changeover valve 973*b* is then turned on and the electromagnetic changeover valve 962*b* is also turned on, high-pressure water in the first chamber 942*b* of the second cylinder 941*b* is sucked into the vacuum pump 971 through the drainage pipe 972*b* and the electromagnetic changeover valve 973*b*, and processing water in the processing water storage tank 931 is introduced into the second chamber 943*b* of the second cylinder 941*b* through the introduction pipe 952*b* and the electromagnetic changeover valve 962*b* to move upward the piston 944*b* in FIG. 2 to return to the state shown in FIG. 2.

By activating the first processing water delivery means 94*a* and the second processing water delivery means 94*b* alternately, processing water can be ejected continuously from the nozzle 7. During the operation of the first processing water delivery means 94*a* and the second processing water delivery means 94*b* for delivering processing water to the nozzle 7, the pressure of the first chamber 942*a* is nearly the same as that of the second chamber 943*a* in the first cylinder 941*a* and the pressure of the first chamber 942*b* is nearly the same as that of the second chamber 943*b* in the second cylinder 94l*b*. Therefore, there is no difference in pressure between the first chamber 942*a* and the second chamber 943*a* of the first cylinder 941*a* and between the first chamber 942*b* and the second chamber 943*b*of the second cylinder 941*b* and hence, processing water in the second chamber 943*a* and the second chamber 943*b* does not enter on the sides of the first chamber 942*a* and the first chamber 942*b*, respectively. Since there is no pressure difference between the first chamber 942*a* and the second chamber 943*a* of the first cylinder 941*a* and between the first chamber 942*b* and the second chamber 943*b* of the second cylinder 941*b* during the operation of the first processing water delivery means 94*a* and the second processing water delivery means 94*b* for delivering processing water to the nozzle 7, processing water in the second chamber 943*a* and the second chamber 943*b* do not enter the first chamber 942*a* and the first chamber 942*b*, respectively. Therefore, the abrasion of the walls of the first cylinder 941*a* and the second cylinder 941*b* and the first piston 944*a* and the second piston 944*b* by the abrasive grains contained in the processing water is suppressed.

In the illustrated embodiment, although an example has been illustrated in which the vacuum pump 971 as a suction means is provided in the drainage means 97 and the pressure means 932 for pressurizing processing water contained in the processing water storage tank 931 is provided, either one of the vacuum pump 971 and the pressure means 932 may be omitted. For example, when the vacuum pump 971 is provided and the pressure means 932 is omitted, the processing water storage tank 931 is made open to the air. In this case, the electromagnetic changeover valves 962*a* and 962*b* installed in the introduction pipes 952*a* and 952*b* for communicating the processing water storage tank 931 with the second chamber 943*a* of the first cylinder 941*a* and the second chamber 943*b* of the second cylinder 941*b* may be check valves which permit circulation of processing water from the processing water storage tank 931 side to the first cylinder 941*a* and the second cylinder 941*b* side but cut off the circulation of processing water in the reverse direction. On the other hand, when the pressure means 932 is provided and the vacuum pump 971 is omitted, the drainage pipes 972*a* and 972*b* are made open to the air.

The CSP substrate as a workpiece to be cut by the above water jet-processing machine will be described with reference to FIG. 4.

Figure 4:
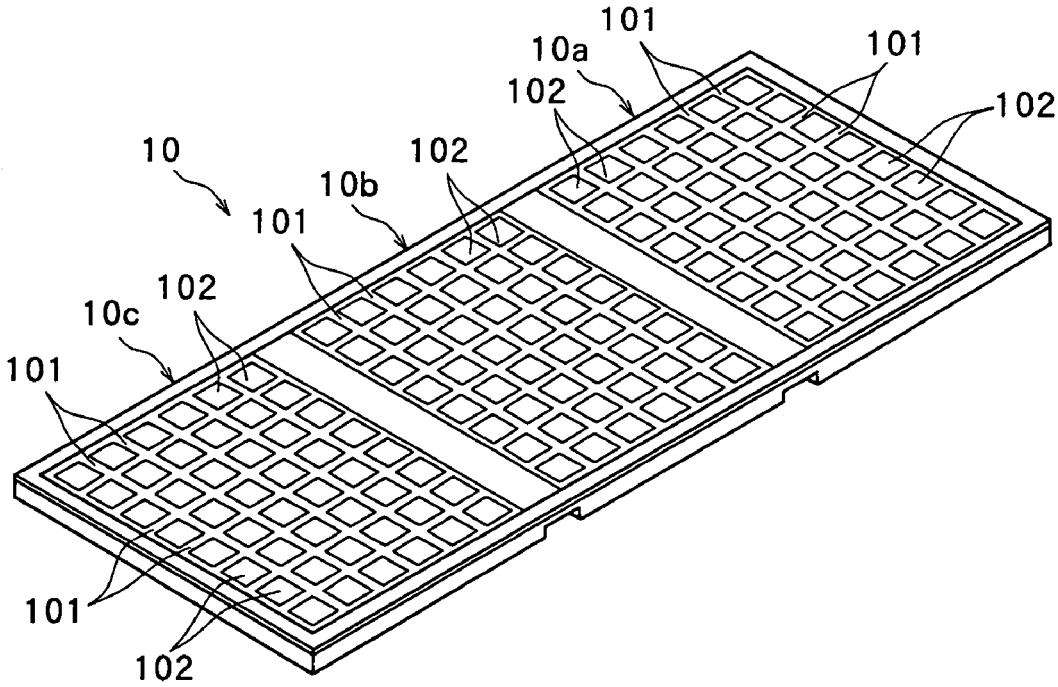
FIG. 4 is a perspective view of a CSP substrate as a workpiece.

The CSP substrate 10 shown in FIG. 4 is divided into three adjoining blocks 10*a*, 10*b* and 10*c*. A plurality of streets 101 are formed in a lattice pattern in each of the three blocks 10*a*, 10*b* and 10*c* constituting the CSP substrate 10 and a chip size package (CSP) 102 is arranged in each of a plurality of areas sectioned by the streets 101. The CSP substrate 10 thus formed is cut along the streets 101 to be divided into individual chip size packages (CSP).

Figure 5:
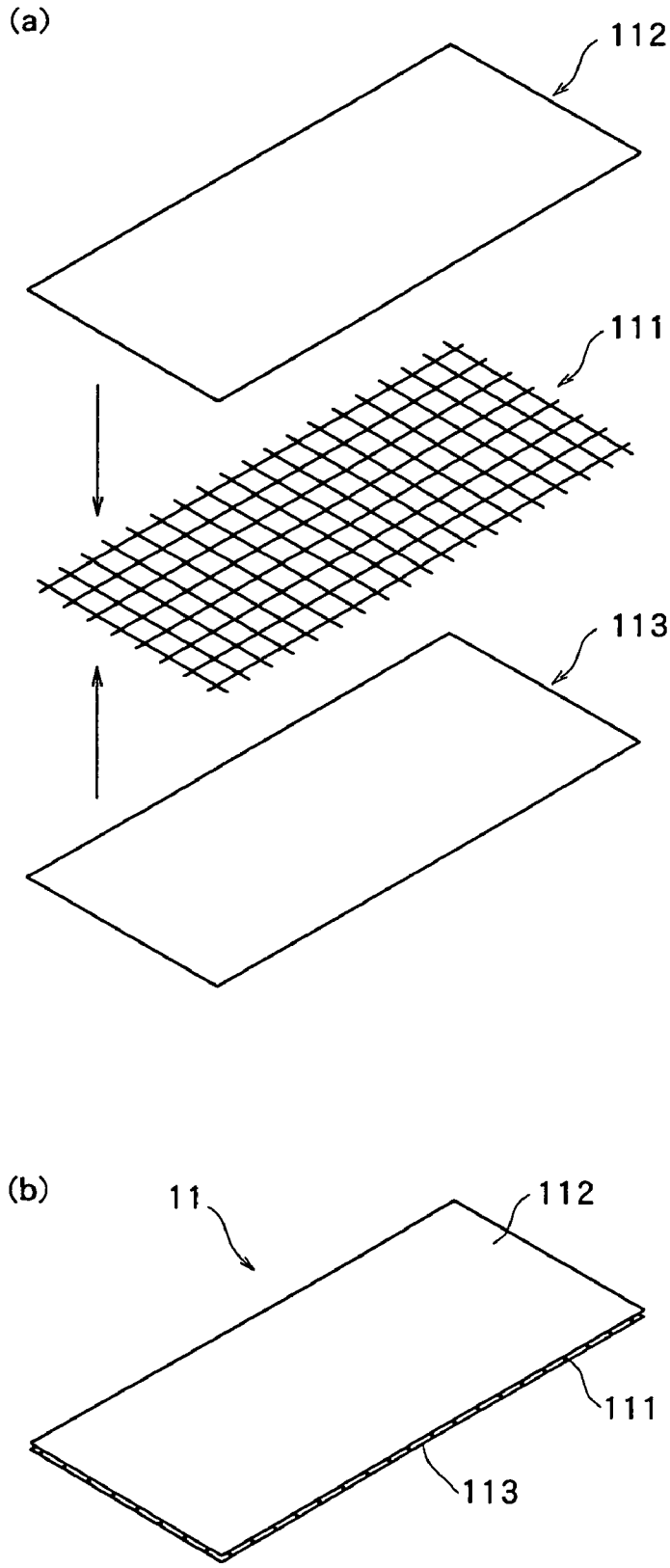
FIGS. 5(*a*) and 5(*b*) are perspective views of a protective member affixed to the CSP substrate as a workpiece.
Figure 6:
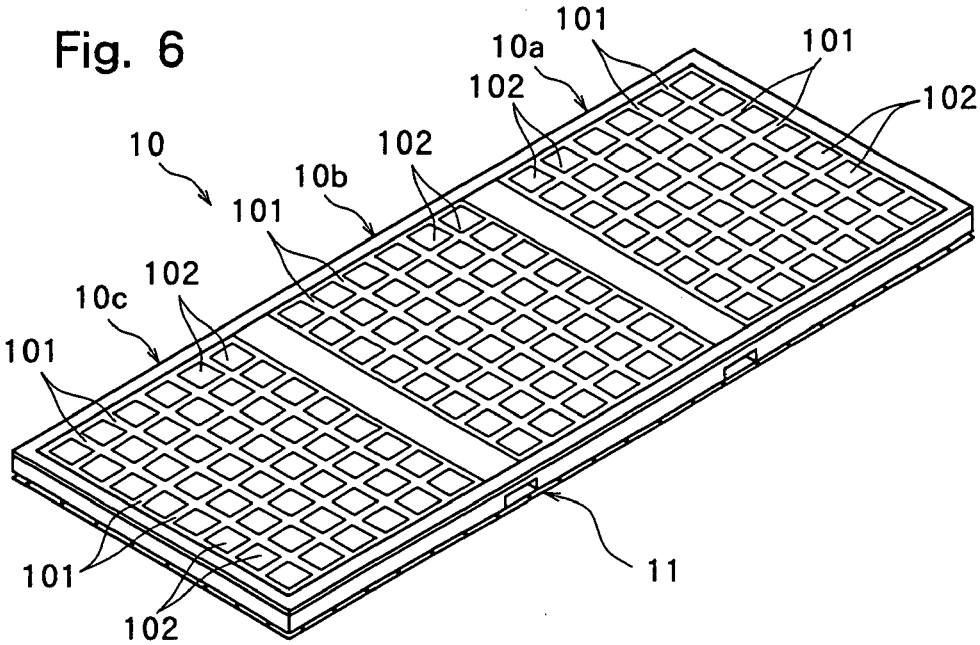
FIG. 6 is a perspective view showing a state where the CSP substrate as a workpiece is assembled with a protective member.

Before the above CSP substrate 10 is cut along the streets 101, a protective member is affixed to the CSP substrate 10. An example of the protective member 11 is shown in FIGS. 5(*a*) and 5(*b*). FIG. 5(*a*) is an exploded perspective view of structural members constituting the protective member 11 and FIG. 5(*b*) is a perspective view of the protective member 11. The protective member 11 shown in FIGS. 5(*a*) and 5(*b*) consists of a net-like reinforcing member 111, a protective sheet 112 placed on the upper surface in the drawing of the reinforcing member 111 and a protective sheet 113 placed on the lower surface in the drawing of the reinforcing member 111. The reinforcing member 111 is formed like a net of a metal thin wire such as a piano wire having a diameter of, for example, about 0.1 to 0.5 mm. The protective sheet 112 is a double-sided adhesive sheet prepared by coating acrylic resin paste to both sides of a resin sheet of polyethylene terephthalate or polyvinyl chloride having a thickness of 0.1 to 0.2 mm and its lower surface in the drawing is bonded to the upper surface of the reinforcing member 111. The protective sheet 113 is a single-sided adhesive sheet prepared by coating acrylic resin paste to the upper surface in the drawing of a resin sheet of polyethylene terephthalate or polyvinyl chloride having a thickness of 0.1 to 0.2 mm, and its upper surface in the drawing is bonded to the lower surface of the reinforcing member 111. The reinforcing member 111 is thus sandwiched between the above protective sheets 112 and 113. When adhesion between the protective sheet 112 and the reinforcing member 111 is high, the protective sheet 113 is not always necessary. The back surface of the CSP substrate 10 is put on the top of the protective sheet 112 of the thus constituted protective member 11, as shown in FIG. 6 (protective member affixing step).

Figure 7:
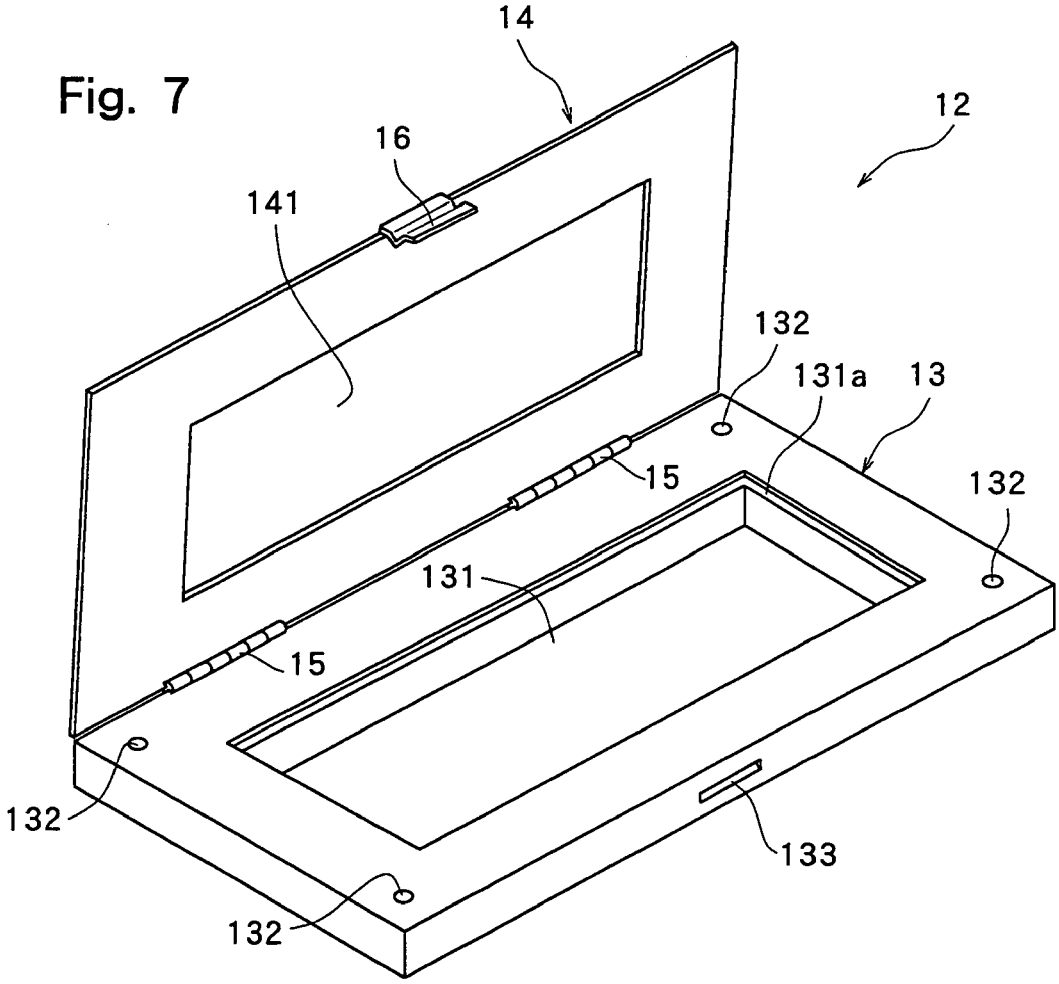
FIG. 7 is a perspective view of a workpiece holding jig for holding the CSP substrate as a workpiece assembled with the protective member and placing it on a workpiece holding table of the water jet-processing machine.

The CSP substrate 10 bonded to the protective member 11 as described above is held by a workpiece holding jig 12 shown in FIG. 7 and held on the above workpiece holding table 6 of the water jet-processing machine. The workpiece holding jig 12 shown in FIG. 7 consists of a lower holding plate 13 and an upper holding plate 14, each sides of which are joined to each other by two hinges 15 and 15. The lower holding plate 13 and the upper holding plate 14 have openings 131 and 141, respectively. The openings 131 and 141 are similar in shape to the CSP substrate 10 but a little smaller than the CSP substrate 10. A stepped portion 131*a* having a thickness corresponding to the total of the above CSP substrate 10 and the protective member 11 from the upper surface of the lower holding plate 13 is formed around the opening 131 of the lower holding plate 13 to accept the above CSP substrate 10. Four pinholes 132 to be fitted to four positioning pins 62 installed on the above workpiece holding table 6 are formed around the opening 131 in the lower holding plate 13. An engaging piece 16 for locking is provided on the other side of the upper holding plate 14 and a engaging hollow 133 to be engaged with the above engaging piece 16 is formed on the other side of the lower holding plate 13.

To cut the above CSP substrate 10 along the streets 101, the CSP substrate 10 bonded to the protective member 11 is first placed in the above stepped portion 131*a* formed in the lower holding plate 13 of the workpiece holding jig 12 in such a manner that the protective member 11 side faces down, the upper holding plate 14 is put on the lower holding plate 13, and the engaging piece 16 is engaged with the engaging hollow 133. The workpiece holding jig 12 holding the CSP substrate 10 interposed between the lower holding plate 13 and the upper holding plate 14 is placed on the above workpiece holding table 6 of the water jet-processing machine shown in FIG. 1. At this point, by fitting the four pin holes 132 formed in the lower holding plate 13 to the four positioning pins 62 provided on the workpiece holding table 6, the workpiece holding jig 12 holding the CSP substrate 10 is held at a predetermined position of the workpiece holding table 6.

Figure 8:
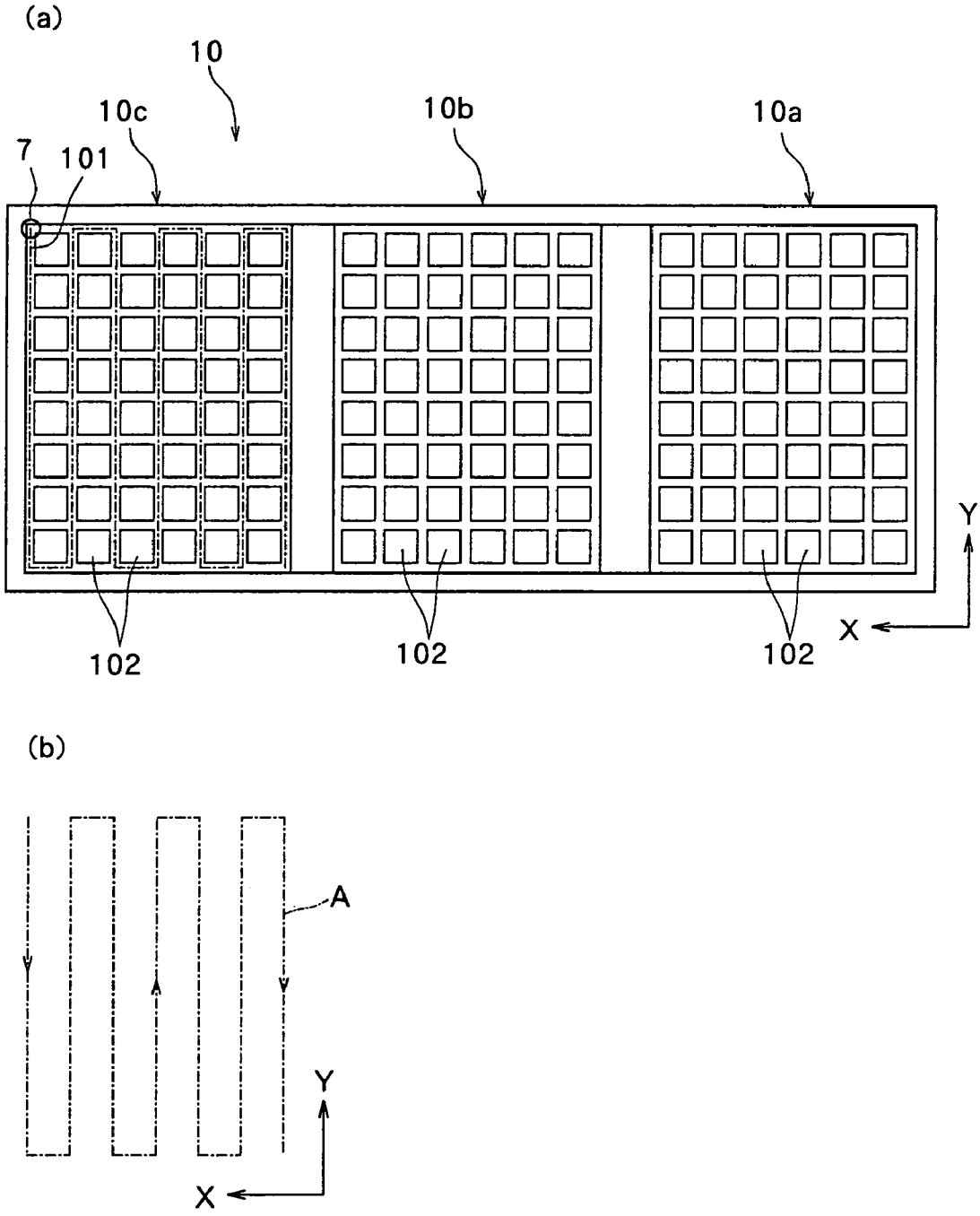
FIGS. 8(*a*) and 8(*b*) are diagrams for explaining a first cutting step for cutting the CSP substrate as a workpiece by the water jet-processing machine shown in FIG. 1.

After the workpiece holding jig 12 holding the CSP substrate 10 is held at the predetermined position of the workpiece holding table 6 of the water jet-processing machine, the first moving means 30 and the third moving means 50 are activated to move the first movable base 3 and the third movable base 5 in the directions indicated by the arrow X and the arrow Y, respectively, in order to move the CSP substrate 10 held on the workpiece holding table 6 to a processing area located below the nozzle 7. Then, the nozzle 7 is aligned with the street 101 at the left end in the drawing of the left block 10*c* of the CSP substrate, as shown in FIG. 8(*a*). Then, the second moving means 40 is activated to move the second movable base 4 in the direction indicated by the arrow Z so as to bring the nozzle 7 at a predetermined position with the interval (for example, 50 μm) above from the surface of the CSP substrate 10.

Thereafter, the processing water supply means 9 is activated as described above to emit a jet of processing water containing abrasive grains from the nozzle 7 and simultaneously, the third moving means 50 and the first moving means 30 are activated to move the third movable base 5 and the first movable base 3 in the directions indicated by the arrow Y and the arrow X sequentially so that the workpiece holding table 6, that is, the CSP substrate 10 is moved along the streets 101 relative to the nozzle 7 as shown by the one-dot chain line in FIG. 8(*a*), that is, the CSP substrate 10 and the nozzle 7 are moved relative to each other in the directions indicated by the arrow Y and the arrow X sequentially as indicated by the arrow A in FIG. 8(*b*). This movement is carried out by the control means 200 that controls the pulse motor 503 of the third moving means 50 and the pulse motor 302 of the first moving means 30 based on data on the interval between streets 101 and the length of the streets, which are beforehand stored in the read-only memory (ROM) 202 or the random access memory (RAM) 203 of the control means 200. As a result, the block 10*c* of the CSP substrate 10 is cut along the streets 101 as shown by the one-dot chain line in FIG. 8(*a*) (first cutting step). At the time of this cutting, a jet of water penetrates the protective sheets 112 and 113 of the protective member 11 affixed to the CSP substrate 10 but the reinforcing member 111 is not cut because it is formed like a net of a metal thin wire. After cutting, the power of a jet of water is weakened by buffer water contained in the water tank 60.

Figure 9:
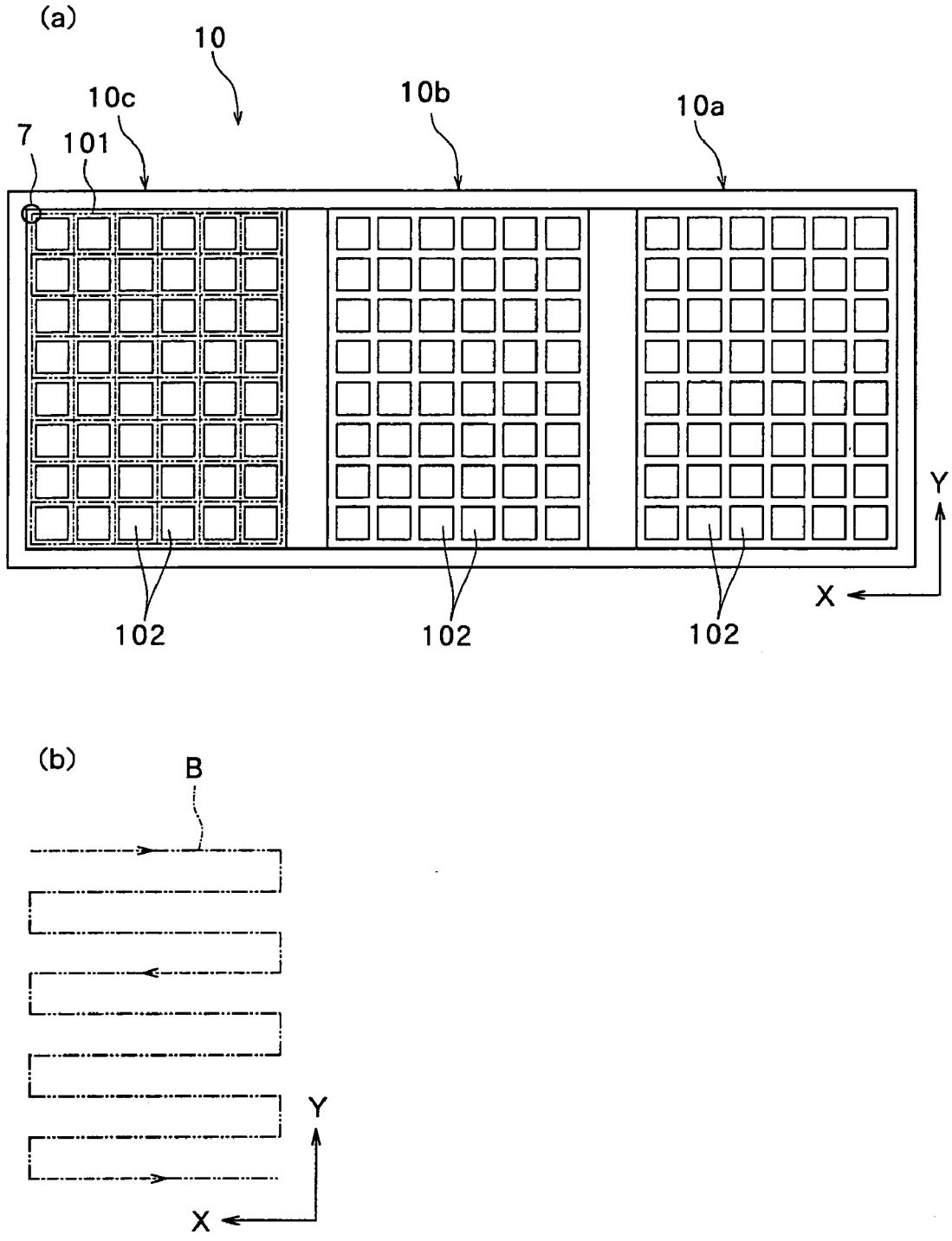
FIGS. 9(*a*) and 9(*b*) are diagrams for explaining a second cutting step for cutting the CSP substrate as a workpiece by the water jet-processing machine shown in FIG. 1.

After the CSP substrate 10 is cut as shown by the one-dot chain line in FIG. 8(*a*), the first moving means 30 and the third moving means 50 are activated to move the first movable base 3 and the third movable base 5 in the directions indicated by the arrow X and the arrow Y so as to bring the street 101 at the left end in the drawing of the left block 10*c* of the CSP substrate 10 again at a position right below the nozzle 7, as shown in FIG. 9(*a*). The processing water supply means 9 is activated as described above to emit a jet of processing water containing abrasive grains from the nozzle 7 and simultaneously, the first moving means 30 and the third moving means 50 are activated to move the first movable base 3 and the third movable base 5 in the directions indicated by the arrow X and the arrow Y sequentially so that the workpiece holding table 6, that is, the CSP substrate 10 is moved along the streets 101 relative to the nozzle 7 as shown by the two-dot chain line in FIG. 9(*a*), that is, the CSP substrate 10 and the nozzle 7 are moved relative to each other in the directions indicated by the arrow X and the arrow Y sequentially as indicated by the arrow B in FIG. 9(*b*). As a result, the block 10*c* of the CSP substrate 10 is cut along the streets 101 as shown by the two-dot chain line in FIG. 9(*a*) (second cutting step). At the time of this cutting, a jet of processing water penetrates the protective sheets 112 and 113 of the protective member 11 affixed to the CSP substrate 10 but the reinforcing member 111 is not cut because it is formed like a net of a metal thin wire.

The block 10*c* of the CSP substrate 10 is cut along the streets 101 as shown by the one-dot chain line and the two-dot chain line in FIG. 8(*a*) and FIG. 9(*a*) to be divided into individual chip size packages (CSP) by carrying out the first cutting step and the second cutting step as described above. After the first cutting step and the second cutting step are carried out on the block 10*c* of the CSP substrate 10 as described above, the first cutting step and the second cutting step are also carried out on the blocks 10*b* and 10*a* of the CSP substrate 10 similarly to cut these blocks along the streets 101 so as to divide them into individual chip size packages (CSP) 102. Since the reinforcing member 111 of the protective member 11 affixed to the CSP substrate 10 is not cut as described above, the CSP substrate 10 divided into individual chip size packages (CSP) maintains the state of the substrate and therefore can be easily carried.

Figure 10:
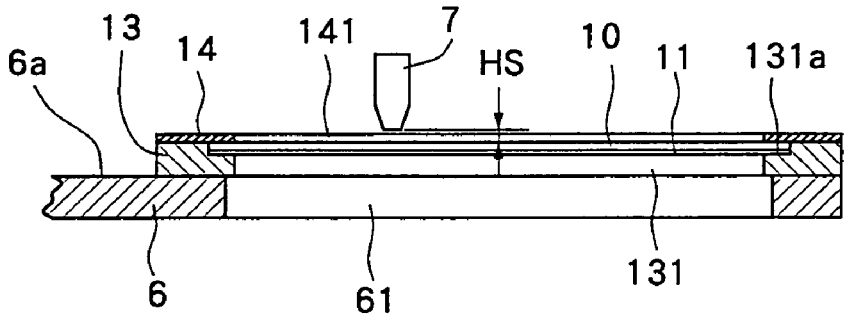
FIG. 10 is a diagram showing the interval between a squirt hole of a nozzle and a surface of the CSP substrate when the CSP substrate as a workpiece is held parallel to the holding surface of the workpiece holding table.
Figure 11:
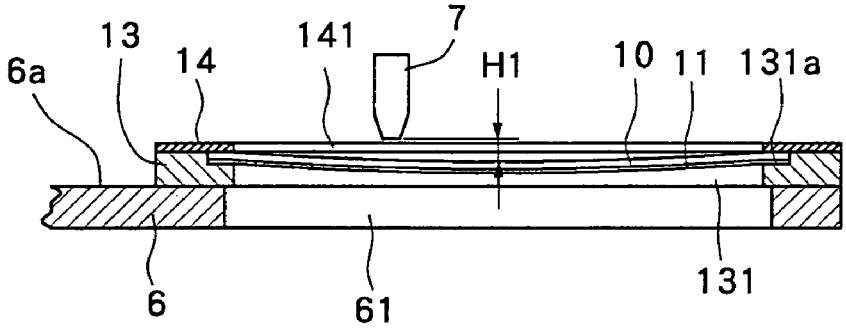
FIG. 11 is a diagram showing the interval between the squirt hole of the nozzle and the surface of the CSP substrate when a center of the CSP substrate as a workpiece curves downward.
Figure 12:
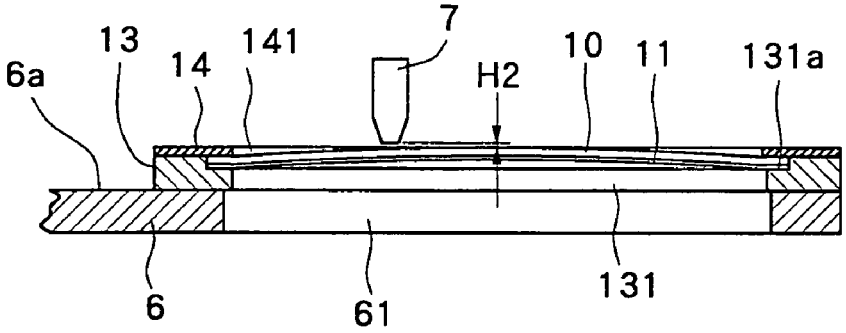
FIG. 12 is a diagram showing the interval between the squirt hole of the nozzle and the surface of the CSP substrate when the center of the CSP substrate as a workpiece curves upward.

When the CSP substrate 10 as a workpiece held by the workpiece holding jig 12 is held parallel to the holding surface 6*a* of the workpiece holding table 6 in the above first cutting step and second cutting step, the interval between the squirt hole of the nozzle 7 and the surface of the CSP substrate 10 is maintained at a predetermined value (HS) (for example, 50 μm), and suitable cutting is carried out, as shown in FIG. 10. However, when the center of the CSP substrate 10 curves downward as shown in FIG. 11 and the center portion is to be cut, the interval (H1) between the squirt hole of the nozzle 7 and the surface of the CSP substrate 10 is larger than the predetermined value (HS) (for example, 50 μm) and thereby the processing accuracy becomes unstable, whereby problems occur in that the cut grooves may become nonuniform in width, an uncut area may be produced, or abrasive grains may be scattered to damage the surface of the workpiece. Meanwhile, when the center of the CSP substrate 10 curves upward as shown in FIG. 12 and the center portion is to be cut, the interval (H2) between the squirt hole of the nozzle 7 and the surface of the CSP substrate 10 is smaller than the predetermined value (HS) (for example, 50 μm), whereby a problem arises in that the nozzle 7 may contact the CSP substrate 10 to damage its surface.

In the illustrated embodiment, a processing sound wave generated by a processing fluid ejected from the nozzle 7 to the CSP substrate 10 as the workpiece in the above first cutting step and the second cutting step is detected by the processing sound wave detection means 70, and its detection signal is sent to the control means 200 as a voltage signal. The control means 200 obtains the interval (H) between the squirt hole of the nozzle 7 and the surface of the CSP substrate 10 based on the voltage signal (V) corresponding to the frequency sent from the processing sound wave detection means 70 and the data map shown in FIG. 3 stored in the read-only memory (ROM) 202. That is, the control means 200 judges the interval (H) between the squirt hole of the nozzle 7 and the surface of the CSP substrate 10 as 50 μm when the voltage signal (V) sent from the processing sound wave detection means 70 is 5.0 (V), 40 μm when the voltage signal (V) sent from the processing sound wave detection means 70 is 4.2 (V) and 60 μm when the voltage signal (V) sent from the processing sound wave detection means 70 is 6.2 (V).

Thereafter, the control means 200 calculates the difference (H0) between the obtained interval (H) between the squirt hole of the nozzle 7 and the surface of the CSP substrate 10 as described above and the predetermined value (HS) (for example, 50 μm) (H0=HS−H). Then, the control means 200 outputs a control signal to the pulse motor 402 of the above second moving means 40 based on the calculated value (H0). That is, when the interval (H) between the squirt hole of the nozzle 7 and the surface of the CSP substrate 10 is larger than the predetermined value (HS) as shown in FIG. 11, the above (H0) becomes a negative value and hence, the control means 200 outputs a control signal to the pulse motor 402 of the above second moving means 40 to rotate it in a normal direction by an amount corresponding to the value (H0). As a result, the above second moving base 4 descends along the pair of guide rails 32 and 32 provided on the first movable base 3 so as to correct the interval (H) between the squirt hole of the nozzle 7 and the surface of the CSP substrate 10 to the predetermined value (HS) (for example, 50 μm). When the interval between the squirt hole of the nozzle 7 and the surface of the CSP substrate 10 is smaller than the predetermined value (HS) as shown in FIG. 12, the above (H0) becomes a positive value and hence, the control means 200 output a control signal to the pulse motor 402 of the second moving means 40 to rotate it in the reverse direction by an amount corresponding to the above value (H0). As a result, the above second movable base 4 ascends along the pair of guide rails 32 and 32 provided on the first movable base 3 so as to correct the interval between the squirt hole of the nozzle 7 and the surface of the CSP substrate 10 to the predetermined value (HS) (for example, 50 μm). Accordingly, in the water jet-processing machine in the illustrated embodiment, even when the CSP substrate 10 as the workpiece curves, the interval between the squirt hole of the nozzle 7 and the surface of the CSP substrate 10 can be always maintained at a predetermined range.

What is claimed is:

1. A water jet-processing machine comprising a workpiece to be cut holding table having a holding surface for holding a workpiece to be cut, a nozzle for emitting a jet of processing water to the workpiece to be cut held on the holding surface of the workpiece to be cut holding table, a processing water supply means for supplying processing water containing abrasive grains to the nozzle and a moving means for moving the nozzle in a direction perpendicular to the holding surface of the workpiece to be cut holding table, wherein the machine further comprises a processing sound wave detection means for detecting a processing sound wave generated by processing water ejected from the nozzle to the workpiece to be cut and a control means for controlling the moving means based on a detection voltage signal detected by the processing sound wave detection means, and wherein the control means comprises a storage means for preforming a data map converting data on a frequency of a processing sound wave stored as a voltage signal corresponding to the interval between the nozzle and a surface of the workpiece to be cut into a voltage signal and beforehand storing the data map, and obtains the interval between the nozzle and the surface of the workpiece to be cut based on the frequency data stored in the storage means and a detection voltage signal detected by the processing sound wave detection means to control the moving means so that the interval becomes a predetermined value.

2. A water jet-processing machine as recited in claim 1, the processing sound wave being ultrasonic.

3. A water jet-processing machine as recited in claim 2, the storage means comprising a read-only memory of said control means.

4. A method for use in a water jet-processing machine comprising a workpiece to be cut holding table having a holding surface for holding a workpiece to be cut, a nozzle for emitting a jet of processing water to the workpiece to be cut held on the holding surface of the workpiece to be cut holding table, a processing water supply means for supplying processing water containing abrasive grains to the nozzle and a moving means for moving the nozzle in a direction perpendicular to the holding surface of the workpiece to be cut holding table, the method comprising:

preforming a frequency data map in read-only memory of a controller from incrementally changing the distance from a first predetermined value to a second predetermined value between said nozzle and said workpiece to be cut and recording a voltage level corresponding to the distance;

responsive to cutting a workpiece to be cut, detecting a processing sound wave generated by processing water ejected from the nozzle to the workpiece to be cut and outputting a detection voltage signal; and determining the interval between the nozzle and a surface of the workpiece to be cut based on the frequency data map pre-formed in read-only memory of the controller and the detection voltage signal output.

5. A method for use in a water jet-processing machine as recited in claim 4, wherein the processing sound wave is ultrasonic.

6. A method for use in a water jet-processing machine as recited in claim 4, wherein the first pre-determined value and the second predetermined value are less than 100 micrometers.

* * * * *